US005140828A

United States Patent [19]

Hagita et al.

[11] Patent Number: 5,140,828

[45] Date of Patent: Aug. 25, 1992

[54] REFRIGERATION CYCLE APPARATUS

[75] Inventors: Naomi Hagita; Takao Mizuno, both of Shimizu, Japan

[73] Assignees: Hitachi, Ltd., Tokyo; Hitachi Shimizu Engineering Co., Ltd., Shizuoka, both of Japan

[21] Appl. No.: 710,817

[22] Filed: Jun. 5, 1991

[30] Foreign Application Priority Data

Jun. 14, 1990 [JP] Japan ..... 2-155647

[51] Int. Cl.[5] ..... F25B 31/00

[52] U.S. Cl. ..... 62/222; 62/505

[58] Field of Search ..... 62/505, 222

[56] References Cited

U.S. PATENT DOCUMENTS 4,748,831 6/1988 Shaw ..... 62/505

FOREIGN PATENT DOCUMENTS 166778 1/1985 Japan .

0117192 5/1988 Japan ..... 62/505

*Primary Examiner*—William E. Wayner

*Attorney, Agent, or Firm*—Antonelli, Terry, Stout & Kraus

[57] ABSTRACT

A refrigeration cycle apparatus wherein a positive displacement type compressor is used as a cooling medium compressor, and part of a high-pressure liquid cooling medium liquefied in a condenser of a refrigeration cycle is introduced into a compression chamber of the compressor during a compression stroke thereof via first and second connecting pipes connected to the compressor, thereby preventing the overheating of the compressor. The position of connection of the first connecting pipe to the compressor is set to such a position of the compression chamber that when an operating pressure ratio requiring the cooling of the compressor is minimum, the pressure within the compression chamber of the compressor during the compression stroke can be below a condensation pressure at the operating pressure ratio. The position of connection of the second connecting pipe to the compressor is set to such a position of the compression chamber that the pressure within the compression chamber during the compression stroke can be above the pressure within the compression chamber communicated with the first connecting pipe. The second connecting pipe is normally opened, and control means is provided for controlling the opening and closing of the fist connecting pipe so as to keep the temperature of the compressor below a predetermined allowable temperature during the operation of the compressor.

5 Claims, 3 Drawing Sheets

REFRIGERATION CYCLE APPARATUS

BACKGROUND OF THE INVENTION

1. Field of the Invention

This invention relates generally to a refrigeration cycle apparatus, such as a refrigerator and an air-conditioner, incorporating a positive displacement type compressor as a cooling medium gas compressor, and more particularly to such a refrigeration cycle apparatus of the type in which part of a high-pressure liquid cooling medium in a refrigeration cycle is introduced into a compression chamber of the compressor so as to prevent the overheating of the compressor. Particularly, this refrigeration cycle apparatus can be suitably used over a wide operating pressure range, and its control is easy.

2. Description of the Prior Art

In various kinds of compressors, there has heretofore been used a method of preventing the overheating of the compressor by introducing part of a high-pressure liquid cooling medium, condensed by a condenser in a refrigeration cycle, into a compression chamber of the compressor. Also, in a refrigeration cycle apparatus (as disclosed in Japanese Patent Unexamined Publication No. 60-166778) employing a compressor of the set volume type, there has been used a method of preventing the overheating of the compressor by introducing a part of a high-pressure liquid cooling medium into a compression chamber of the compressor during its compression stroke via a connecting pipe communicated with the compression chamber.

To introduce the high-pressure liquid cooling medium, condensed by the condenser in the refrigeration cycle, into the compression chamber of the compressor during the compression stroke via the connecting pipe is only possible when the pressure within the compression chamber communicated with the connecting pipe is lower than the pressure of the high-pressure liquid cooling medium supplied to the connecting pipe. Therefore, the pressure within the compression chamber (which is communicated with the connecting pipe) during the compression stroke is determined by the position of connection of the connecting pipe relative to the compressor and the pressure at the low pressure side of the refrigeration cycle (i.e., the inlet pressure of the compressor) during the operation. Therefore, depending on operating pressure conditions, it is possible that the pressure within the compression chamber communicated with the connecting pipe becomes higher than the pressure of the high-pressure liquid cooling medium supplied to the connecting pipe, so that the introduction of the liquid cooling medium into the compression chamber is impossible, which may result in the overheating of the compressor. Also, depending on the operating pressure conditions, it is possible that the former pressure becomes very much lower than the latter pressure, so that an amount of introduction of the liquid cooling medium into the compression chamber become excessive due to this pressure differential, which may unduly increase the amount of electric power consumed by the compressor and may invite the overcooling of the compressor.

Thus, in the prior art, it has not been clearly described how to determine the position of connection of the high-pressure liquid cooling medium introduction connecting pipe relative to the compressor in order that the prevention of the overheating of the set volume-type compressor by the introduction of the high-pressure liquid cooling medium can be properly effected easily over a wide operating pressure range. Thus, with the prior art, it has been difficult to properly cool the compressor over a wide operating pressure range for the purpose of preventing the overheating of the compressor.

SUMMARY OF THE INVENTION

In view of the above deficiencies of the prior art, it is an object of this invention to provide a refrigeration cycle apparatus in which over a wide operating pressure range, a high-pressure liquid cooling medium is introduced into a compression chamber of a positive displacement type compressor via connecting pipes connected respectively to appropriate positions of the compressor, thereby effectively preventing the overheating of the compressor and achieving a high efficiency of the operation by a simple control.

In order to achieve the above object, a refrigeration cycle apparatus according to the present invention will be described below.

In FIG. 2, an abscissa axis represents an evaporation pressure, and an ordinate axis represents a condensation pressure. Here, the evaporation pressure means an outlet pressure of an evaporator, that is, an inlet pressure of a compressor, and the condensation pressure means an inlet pressure of a condenser, that is, an outlet pressure of the compressor. In FIG. 2, a hatched region or block represents an operating pressure range in which the evaporation pressure is in the range of Ps1 to Ps2, and the condensation pressure is in the range of Pd1 to Pd2. Straight lines passing through the origin of FIG. 2 are constant pressure ratio lines each indicating that the operating pressure ratio (the ratio of the condensation pressure to the evaporation pressure, i.e., the ratio of the outlet pressure to the inlet pressure of the compressor) is constant. Among these straight lines, in the operating pressure range, the straight line O represents the maximum operating pressure ratio, and the straight line Q represents the minimum operating pressure ratio. A curved line l represents the relation between the evaporation pressure and the condensation pressure obtained when cooling the compressor (particularly, its motor) so that its temperature will not exceed a predetermined allowable temperature from the viewpoint of the design. In the operating pressure range, a region R above the curved line l represents the range where the cooling of the compressor is needed, and a region S below the curved line l represents the range where the cooling of the compressor is not needed. The constant pressure ratio line P, passing through a point m on the curved line l at the right limit (FIG. 2) of the operating pressure range, represents the minimum operating pressure ratio P requiring the cooling of the compressor in the operating pressure range. In this specification, the straight lines serving as constant pressure ratio lines and the operating pressure ratios represented respectively by these straight lines are indicated by the same signs or characters, respectively.

In the present invention, the position of connection between a first connecting pipe for introducing a high-pressure liquid cooling medium and the compressor is so determined that in the range where the operating pressure ratio is above P, the high-pressure liquid cooling medium can be introduced into a compression chamber of the compressor during its compression stroke so as to cool the compressor. In other words, the position of the first connecting pipe is so determined that the ratio of the pressure within the compression chamber (which is communicated with the first connecting pipe) of the compressor during the compression stroke to the evaporation pressure (i.e., the inlet pressure of the compressor) can be below the operating pressure ratio P. On the other hand, the position of connection between a second connecting pipe for introducing the high-pressure liquid cooling medium and the compressor is so determined that the pressure within the compression chamber of the compressor communicated with the second connecting pipe during the compression stroke can be higher than the pressure within the compression chamber of the compressor communicated with the first connecting pipe during the compression stroke, and that the ratio of the former pressure within the compression chamber to the evaporation pressure is below the maximum operating pressure ratio O. The high-pressure liquid cooling medium is supplied to each of the connecting pipes only during the operation of the compressor. There is further provided valve means for opening and closing the first and second connecting pipes, and the second connecting pipe is normally open during the operation, and only the first connecting pipe is controlled with respect to its opening and closing. To control the opening and closing of the first connecting pipe in accordance with the temperature of the discharge gas of the compressor is the simplest and the most accurate.

The operation of the present invention will be described with reference to FIG. 3. In FIG. 3, the abscissa axis represents the operating pressure ratio, and the ordinate axis represents the temperature of the discharge gas from the compressor. Reference characters O, P and Q give the same meanings as in FIG. 2. P represents such operating pressure ratio that the high-pressure liquid cooling medium can be introduced from the first connecting pipe into the compression chamber of the compressor (that is, the pressure within the compression chamber of the compressor communicated with the first connecting pipe can be lower than the pressure of the high-pressure liquid cooling medium supplied to the first connecting pipe). P1 represents such operating pressure ratio that the high-pressure liquid cooling medium can be introduced from the second connecting pipe into the compression chamber of the compressor (that is, the pressure within the compression chamber of the compressor communicated with the second connecting pipe can be lower than the high-pressure liquid cooling medium supplied to the second connecting pipe). T1 and T2 represent those temperatures of the compressor discharge gas which decide the opening and closing of the first connecting pipe, respectively. When the temperature of the compressor discharge gas rises to T1, the first connecting pipe is opened, and when this temperature drops to T2, the first connecting pipe is closed. A line t represents an allowable minimum constant overheating degree of the discharge gas. t1 represents a change in the discharge gas temperature when the high-pressure liquid cooling medium is introduced from the first connecting pipe into the compression chamber of the compressor. t2 represents a change in the discharge gas temperature when the high-pressure liquid cooling medium is introduced from the second connecting pipe into the compression chamber of the compressor. P2 represents such operating pressure ratio that the discharge gas temperature can be T2 when the high-pressure liquid cooling medium is introduced from the first connecting pipe. P3 represents such operating pressure ratio that the discharge gas overheating degree can be t when the high-pressure liquid cooling medium is introduced from the first connecting pipe.

Reference is now made to how to determine the above temperatures T1 and T2. The temperature T1 is set to be lower than the allowable maximum temperature of the compressor (usually, the allowable maximum temperature of its motor). The temperature T2 ($T1 > T2$) is set to be above such a minimum value as to prevent the high-pressure liquid cooling medium, introduced into the compression chamber of the compressor, from being compressed in the liquid state. The discharge gas temperature is kept in the range of between T1 and T2 by controlling the opening and closing of the first connecting pipe to control the introduction of the high-pressure cooling medium from the first connecting pipe.

The operation will be described with respect to the relation between the operating pressure ratio and the discharge gas temperature. When the operating pressure ratio is in the range of between Q and P, the discharge gas temperature is below the allowable maximum temperature, and therefore the introduction of the liquid cooling medium into the compression chamber of the compressor is not needed. When the operating pressure ratio is in the range of between P and P2, the discharge gas temperature is above the allowable maximum temperature, and therefore the fist connecting pipe is opened so as to introduce the high-pressure liquid cooling medium from the first connecting pipe into the compression chamber of the compressor, thereby cooling the discharge gas. When the operating pressure ratio is above P1, the liquid cooling medium flows also from the normally-open second connecting pipe into the compression chamber of the compressor. When the operating pressure ratio is in the range of between P2 and O, the discharge gas temperature is below T2, and therefore the first connecting pipe is closed, and the high-pressure liquid cooling medium flows only from the second connecting pipe into the compression chamber of the compressor, so that the discharge gas is not excessively cooled but is appropriately cooled so as not to be below the allowable minimum overheating degree curve t.

In the above manner, the appropriate cooling of the compressor can be effected by the simple control over the wide operating pressure range from the operating pressure ratio Q to the operating pressure ratio O.

DESCRIPTION OF THE PREFERRED EMBODIMENTS

A preferred embodiment of a refrigeration apparatus of the invention will now be described. In this embodiment, freon R22 is used as a cooling medium, and an operating evaporation temperature is in the range of −65° C. to +5° C., and a scroll compressor is used as a compressor of the positive displacement type.

Figure 4:
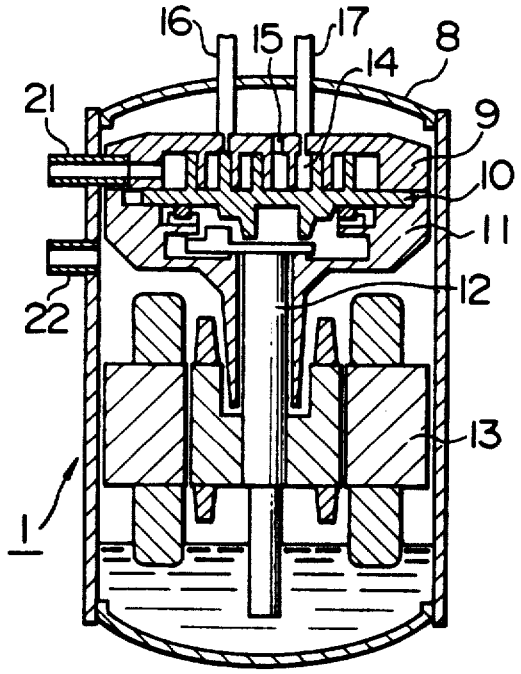
FIG. 4 is a cross-sectional view of a scroll compressor used in the above embodiment.

FIG. 4 shows the scroll compressor 1 used in this embodiment. This compressor is sealed in a closed or sealed container 8, and comprises a fixed scroll 9, a revolving scroll 10, a frame 11, an electric motor 13, a crank shaft 12, and etc. The fixed scroll 9 and the revolving scroll 10 have volute laps, respectively, and the revolving scroll 10 is held between the fixed scroll 9 and the frame 11. The two scrolls 9 and 10 are engaged with each other in such a manner that their laps are in contact with each other, thereby forming a compression chamber 14 therebetween. The crank shaft 12 is rotated by the electric motor 13, so that the revolving scroll 10, while being prevented by an Oldham's mechanism from rotation about its axis, revolves relative to the fixed scroll 9. The cooling medium gas, fed from an intake pipe 21 into the compression chamber 14 in response to the above revolution of the revolving scroll 10, is compressed as the compression chamber 14 is sealed and gradually decreased in volume to move toward the centers of the two scrolls. As a result, the cooling medium gas is discharged into the sealed container 8 via a discharge hole 15, formed at the center of the fixed scroll 9, so as to cool the electric motor 13, and then is discharged to the exterior of the container 8 via a discharge pipe 22.

Figure 5:
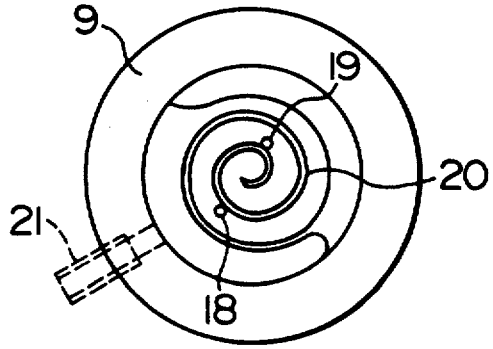
FIG. 5 is a bottom view of a fixed scroll of the compressor.

A first connecting pipe 16 and a second connecting pipe 17 both of which serve to introduce the high-pressure liquid cooling medium into the compression chamber 14 are connected to a mirror plate of the fixed scroll 19. As shown in FIG. 5, communication holes 18 and 19 are formed through the mirror plate of the fixed scroll 9, and are disposed close to the volute lap 20 of the fixed scroll 9. The first and second connecting pipes 16 and 17 are connected to the communication holes 18 and 19, respectively.

The compression chamber 14, formed between the volute laps of the fixed scroll 9 and the revolving scroll 10, is communicated with each of the communication holes 18 and 19 only during a certain period of the compression stroke. Such communication periods are determined by the positions of provision of the communication holes 18 and 19 relative to the mirror plate of the fixed scroll 9, that is, by the positions of connection of the first and second connecting pipes 16 and 17 relative to the mirror plate of the fixed scroll 9. These connecting positions will be described later.

Figure 1:
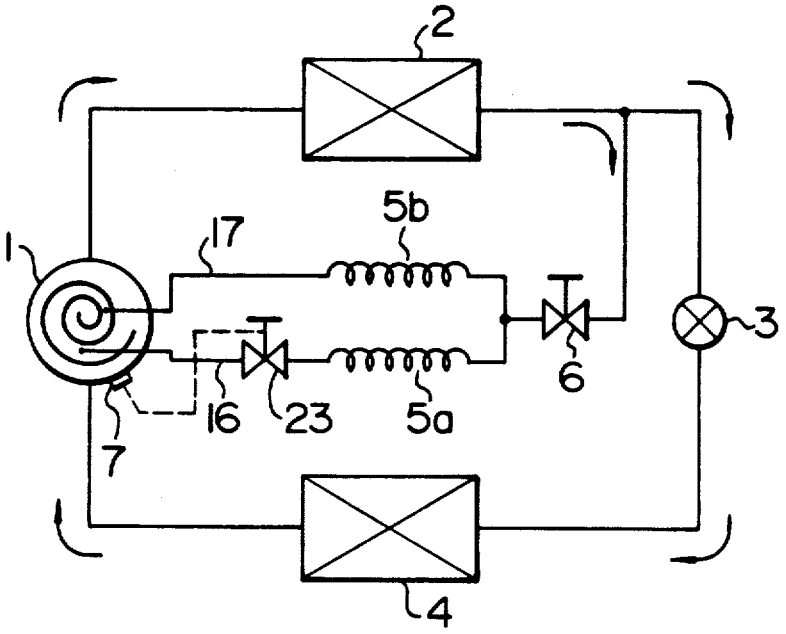
FIG. 1 is a schematic view showing the construction of a preferred embodiment of a refrigeration cycle apparatus of the present invention.

FIG. 1 shows the refrigeration cycle of this embodiment. The high-temperature, high-pressure gas cooling medium, discharged from the compressor 1, is condensed by a condenser 2 into a high-pressure liquid cooling medium, and then this liquid cooling medium is decreased in pressure by an expansion valve 3, and then this liquid cooling medium is evaporated by an evaporator 4, and then is fed into the compressor 1. On the other hand, part of the high-pressure liquid cooling medium branches off at the outlet side of the condenser 2, and is passed through a solenoid valve 6, and then is branched into branch passages 5*a* and 5*b*, and the thus branched cooling mediums reach the first and second connecting pipes 16 and 17, respectively. A solenoid valve 23 is provided only on the first connecting pipe 16. The solenoid valve 6 is opened only during the operation of the compressor 1. A thermostat 7 mounted on the compressor 1 detects the temperature of the discharge gas from the compressor 1 so as to control the opening and closing of the solenoid valve 23, thereby controlling the opening and closing of the fist connecting pipe 16. The upper limit temperature and lower limit temperature of the operating differential of the thermostat 7 are set to the above temperatures T1 and T2, respectively. When the temperature of the compressor discharge gas rises to the temperature T1, the solenoid valve 23 is opened, and when this discharge gas temperature drops to the temperature T2, the solenoid valve 23 is closed.

Figure 2:
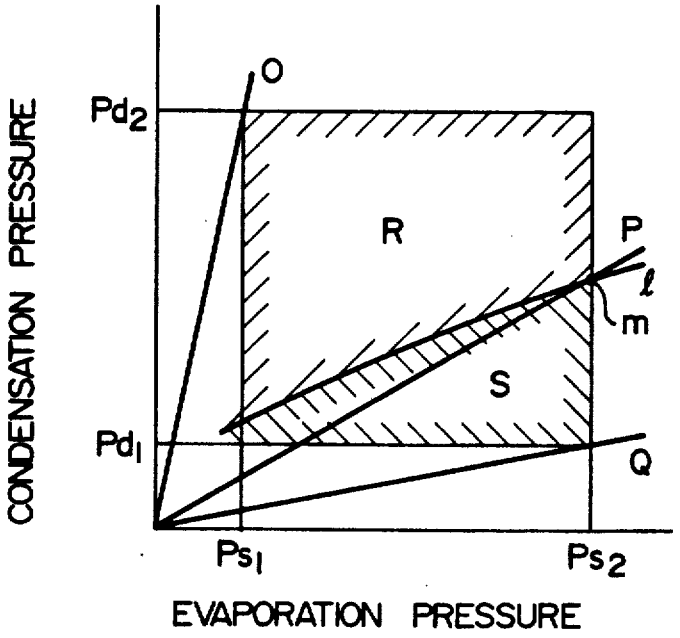
FIGS. 2 and 3 are graphs explanatory of the present invention.
Figure 3:
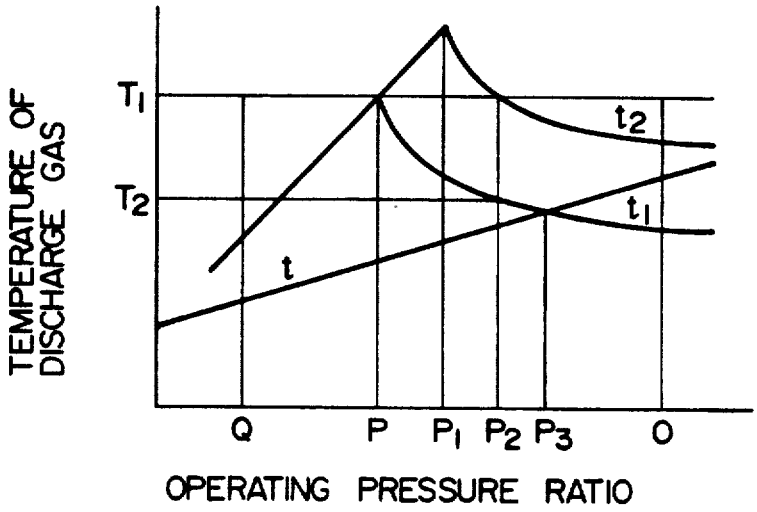
Figure 6:
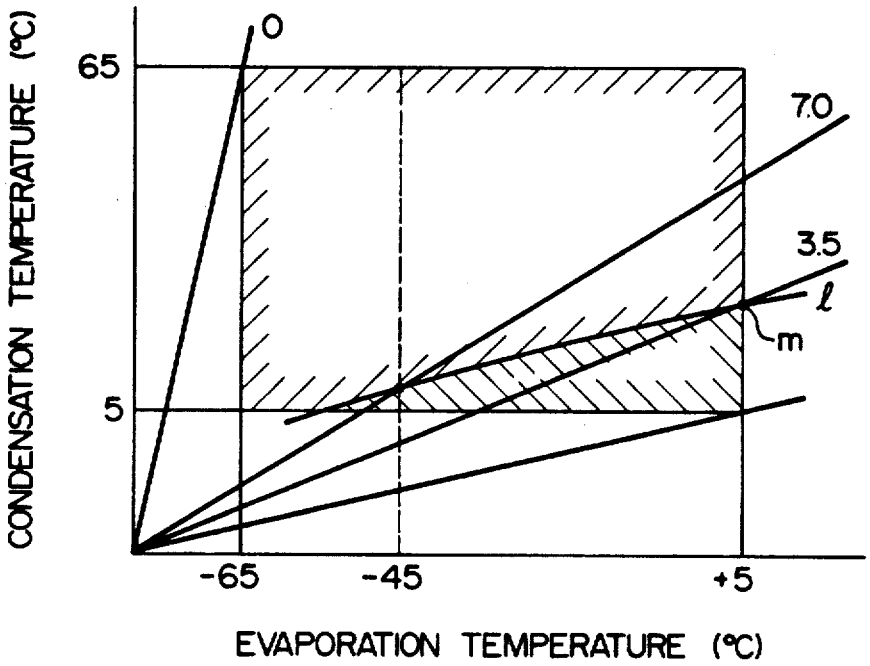
FIGS. 6 and 7 are graphs showing how the positions of connection of first and second connecting pipes are determined in the above embodiment.

The positions of connection of the first and second connecting pipes 16 and 17 (i.e., the positions of provision of the communication holes 18 and 19 in the mirror plate of the fixed scroll 19) are determined in the manner described above. More specifically, these connecting positions in this embodiment will now be described with reference to FIG. 6 (corresponding to FIG. 2) and FIG. 7.

In this embodiment, it is assumed that the allowable maximum discharge gas temperature (the temperature determining a curve l) for the compressor 1 is 110° C. The position of connection of the first connecting pipe 16 relative to the compressor 1 is set to such a position (point m) that in the operating pressure range, the high-pressure liquid cooling medium can be introduced into the compression chamber of the compressor at the operating pressure ratio higher than the lowest (minimum) operating pressure ratio at which the discharge gas temperature reaches 110° C. This will be described in further detail. In this embodiment, the lowest operating pressure ratio at which the evaporation temperature is 110° C. is 3.5. Therefore, it is necessary that the position of connection of the first connecting pipe should be set at such a position that at the operating pressure ratio of above 3.5, the high-pressure liquid cooling medium can be introduced from the condenser into the compression chamber of the compressor during the compression stroke so as to cool the compressor. Such connecting position is determined in the following manner.

Figure 7:
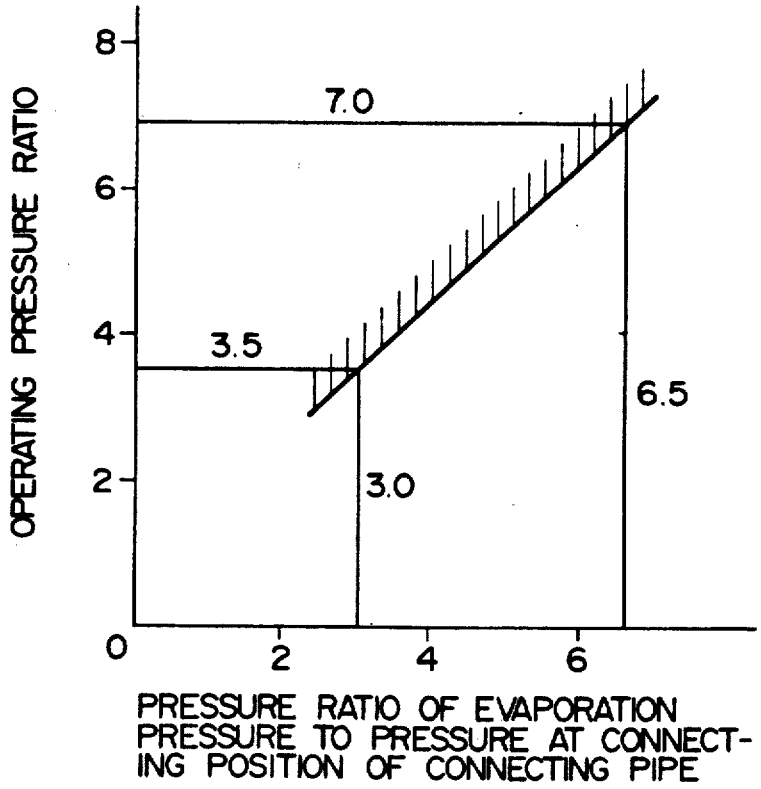

FIG. 7 is a graph obtained from experiments with respect to this embodiment. In this graph, the ordinate axis represents the operating pressure ratio, and the abscissa axis represents such ratio of the mean pressure within the compression chamber of the compressor communicated with the first connecting pipe during the compression stroke (i.e., the means pressure within the compression chamber during the communication of the compression chamber with the first connecting pipe) to the evaporation pressure that at the operating pressure ratio above the above-mentioned operating pressure ratio, the high-pressure liquid cooling medium can be introduced from the first connecting pipe. In FIG. 7, such value of the ratio on the abscissa axis that at the operating pressure ratio of above 3.5, the high-pressure liquid cooling medium can be introduced into the compression chamber from the first connecting pipe communicated therewith is 3.0 which is lower 0.5 than the operating pressure ratio of 3.5. Therefore, the position of connection of the first connecting pipe is so determined that the ratio of the means pressure of the compression chamber to the evaporation pressure can be 3.0.

Next, the position of connection of the second connecting pipe 17 is so determined that the high-pressure liquid cooling medium can be introduced into the compression chamber, communicated with the second connecting pipe, when the evaporation temperature is −45° C., in the following manner. Namely, in FIG. 6, the operating pressure ratio requiring the introduction of the high-pressure liquid cooling medium at the evaporation temperature of −45° C. is 7.0. Therefore, by applying this to FIG. 7, the position of connection of the second connecting pipe 17 is so determined that the ratio of the mean pressure of the compression chamber communicated with the second connecting pipe to the evaporation pressure can be 6.5.

With the above arrangement, even at the low evaporation temperature at which the amount of circulation of the cooling medium is reduced, the operation can be satisfactorily carried out over the wide operating pressure range by the simple control based on the discharge gas temperature without inviting the overheating above the allowable temperature of the compressor and also without inviting the overcooling so as to prevent the high-pressure liquid cooling medium, introduced into the compressor, from being compressed in the liquid state.

In the refrigeration cycle apparatus of the present invention, part of the high-pressure liquid cooling medium liquefied in the condenser of the refrigeration cycle is introduced into the compression chamber of the compressor during the compression stroke via the connecting pipes so as to prevent the overheating of the compressor. The two connecting pipes for introducing the high-pressure liquid cooling medium are connected respectively to the appropriate positions of the compressor, and only the low pressure-side connecting pipe out of the two connecting pipes is controlled to be opened and closed so as to suitably effecting the cooling over the wide operating pressure range with the simple construction, thereby preventing the insufficient cooling of the compressor, the unnecessary cooling thereof and the increase of the power to be consumed. Therefore, the operation can be carried out efficiently over the wide operating range from the time of start of the cooling of a warehouse or a room to be cooled to the time when the cooling temperature thereof becomes stable at a predetermined temperature. Further, during the stable operating condition at the predetermined temperature, the cooling is effectively carried out by the liquid cooling medium introduced from the high pressure-side second connecting pipe, and therefore the frequency of the opening and closing of the low pressure-side first connecting pipe can be reduced. This advantageously prolongs the lifetime of the devices used, and reduces accidents of the products.

What is claimed:

1. In a refrigeration cycle apparatus wherein a positive displacement type compressor is used as a cooling medium compressor, and part of a high-pressure liquid cooling medium liquefied in a condenser of a refrigeration cycle is introduced into a compression chamber of said compressor during a compression stroke thereof via first and second connecting pipes connected to said compressor, thereby preventing the overheating of said compressor, the improvement wherein a position of connection of said first connecting pipe to said compressor is set to such a position of said compression chamber that in an operating pressure ratio more than that being lowest in an operating pressure range, the pressure within said compression chamber of said compressor during the compression stroke can be below a condensation pressure at said operating pressure ratio;

a position of connection of said second connecting pipe to said compressor is set to such a position of said compression chamber that the pressure within said compression chamber during the compression stroke can be above the pressure within said compression chamber communicated with said first connecting pipe; and said second connecting pipe is normally opened, and control means is provided for controlling the opening and closing of said first connecting pipe so as to keep a temperature of said compressor below a predetermined allowable temperature during the operation of said compressor.

2. A refrigeration cycle apparatus according to claim 1, wherein the position of connection of said first connecting pipe to said compressor is set to such a position of said compression chamber that in the operating pressure ratio more than that being lowest in the operating pressure range, a mean pressure of said compression chamber during the compression stroke during the communication of said compression chamber with said first connecting pipe can be lower a predetermined value than the condensation pressure at said operating pressure ratio.

3. A refrigeration cycle apparatus according to claim 1 or 2, wherein said control means controls the opening and closing of said first connecting pipe by detecting a temperature of a discharge gas from said compressor.

4. A refrigeration cycle apparatus according to claim 1, wherein the minimum operating pressure ratio requiring the introduction of the high-pressure liquid cooling medium from the position of connection of said first connecting pipe to said compressor is 3.5, and the operating pressure ratio requiring the introduction of the high-pressure liquid cooling medium from the position of connection of said second connecting pipe to said compressor is 7.0.

5. A refrigeration cycle apparatus according to claim 4, in which the position of connection of said first connecting pipe to said compressor is so determined that the ratio of the mean pressure of said compression chamber communicated with said first connecting pipe to the evaporation pressure can be 3.0, and the position of connection of said second connecting pipe to said compressor is so determined that the ratio of the mean pressure of said compression chamber communicated with said second connecting pipe to the evaporation pressure can be 6.5.

* * * * *